US008387832B2

(12) United States Patent
Zlatic

(10) Patent No.: US 8,387,832 B2
(45) Date of Patent: Mar. 5, 2013

(54) DISPENSER HOUSING

(75) Inventor: Doug Zlatic, North Royalton, OH (US)

(73) Assignee: GOJO Industries, Inc., Akron, OH (US)

( * ) Notice: Subject to any disclaimer, the term of this patent is extended or adjusted under 35 U.S.C. 154(b) by 623 days.

(21) Appl. No.: 12/399,426

(22) Filed: Mar. 6, 2009

(65) Prior Publication Data

US 2010/0224651 A1 Sep. 9, 2010

(51) Int. Cl.
*A47K 5/14* (2006.01)

(52) U.S. Cl. ..... 222/182; 222/181.3; 222/190; 222/195; 222/96; 222/214; 222/325

(58) Field of Classification Search ..... 222/180–183, 222/190, 195, 206, 209, 212–214, 325, 95, 222/96, 103, 105, 505, 508, 101, 102
See application file for complete search history.

(56) References Cited

U.S. PATENT DOCUMENTS

| | | | | |
|---|---|---|---|---|
| 1,306,830 | A * | 6/1919 | Moore | 401/143 |
| 3,926,347 | A | 12/1975 | Low | |
| 4,324,348 | A | 4/1982 | Johnson | |
| 4,349,131 | A * | 9/1982 | Arabian | 222/135 |
| 4,463,876 | A | 8/1984 | Swallert | |
| 4,722,457 | A | 2/1988 | Bedwell et al. | |
| 4,932,562 | A | 6/1990 | Christine | |
| 5,105,984 | A | 4/1992 | Kazimir | |
| 5,431,304 | A | 7/1995 | Gentile | |
| 5,897,030 | A | 4/1999 | Stangle | |
| 6,152,330 | A | 11/2000 | Polan | |
| 6,305,580 | B1 * | 10/2001 | Chen | 222/162 |
| 6,695,174 | B2 | 2/2004 | Sorensen | |
| 7,048,152 | B2 | 5/2006 | Bunoz | |
| 7,066,356 | B2 * | 6/2006 | Schuman et al. | 222/153.01 |
| 7,278,554 | B2 | 10/2007 | Armstrong | |
| 7,281,643 | B2 * | 10/2007 | Lin | 222/214 |
| 2007/0137643 | A1 * | 6/2007 | Bonney et al. | 128/200.23 |
| 2008/0083786 | A1 | 4/2008 | Marin | |
| 2009/0212073 | A1 * | 8/2009 | Haworth | 222/181.3 |

FOREIGN PATENT DOCUMENTS

| | | | |
|---|---|---|---|
| EP | 0787457 | A2 | 8/1997 |
| FR | 2134935 | A5 | 12/1972 |
| GB | 1197918 | A | 7/1970 |
| WO | 0128397 | A1 | 4/2001 |

* cited by examiner

*Primary Examiner* — J. Casimer Jacyna
(74) *Attorney, Agent, or Firm* — Renner Kenner Greive Bobak Taylor & Weber

(57) ABSTRACT

A dispenser including a housing with a backplate, an intermediary member pivotally connected to the backplate, and a cover pivotally connected to the intermediary member. The intermediary member is pivotally connected to the backplate adjacent to a first end of the housing, and the cover is pivotally connected to the intermediary member adjacent to a second end of the housing. The dispenser also includes a refill unit including a pump and a product reservoir. The product reservoir is flexible and resilient so that it can be compressed repeatedly.

10 Claims, 7 Drawing Sheets

DISPENSER HOUSING

TECHNICAL FIELD

The invention herein resides in the art of product dispensers. More particularly, the invention relates to a product dispenser wherein product is dispensed by compressing a flexible and resilient product container. In addition, the invention relates to a product dispenser wherein a housing cover pivots relative to an intermediary member of the housing, which is pivotally connected to a backplate of the housing.

BACKGROUND OF THE INVENTION

For many years, it has been known to dispense liquids, such as soaps, sanitizers, cleansers, disinfectants, lotions, and the like from a dispenser housing maintaining a refill unit that holds the liquid in a product reservoir and provides the pump mechanisms for dispensing the liquid from the reservoir. These dispenser housings generally include a backplate that is wall-mounted and a cover that includes an actuating mechanism to actuate the pump mechanism. The cover is typically hinged to the backplate adjacent to the top of the dispenser to allow it to pivot between an open position, wherein a refill unit can be removed or installed, and closed position, wherein the dispenser can be actuated to dispense product.

A pushbar is often hinged to the cover and pivoted to cause the dispensing of product from a refill unit retained in the housing. However, some dispensers employ a single piece integral cover and pushbar in which the cover pivots as a whole to actuate the pump mechanics of the refill unit within the housing. These types of dispensers are often desired due to their appearance and simplicity of construction since the pushbar is not a separate hinged element. The pump mechanism employed with such dispensers has typically been a liquid pump or a foam generating pump, simply emitting a predetermined quantity of the liquid or foam upon movement of the cover/pushbar. In most cases, the pivoting cover engages the pump mechanism as it is pressed, thereby actuating the pump and causing the dispensation of liquid or foam. In some cases, an inwardly extending projection is provided on the interior of the pivoting cover, and the projection engages the pump mechanism.

It is also known in the art to provide an inwardly extending projection sized and spaced to engage a flexible product reservoir of the refill unit. The compression of the product reservoir by the projection causes actuating of the pump mechanism, and the dispenser housing must therefore provide some room for the flexing and expansion of the product reservoir. It has been found, however, that the prior art dispensers of this type provide an insufficient amount of space and therefore do not within the housing around the product reservoir to allow the pump to work effectively. Open space is necessary around the flexible product reservoir to allow for the flexing and expansion thereof in several directions during compression so as to permit the pump to function at a high efficiency, using all of the force and displacement provided by the engagement of the inwardly extending projection. With insufficient open space surrounding the product reservoirs, these known pump housings may require several actuations of the pump mechanism in order to dispense the desired volume of liquid or foam.

Another common disadvantage of prior art pump housings results from the connection between the pivoting cover and the backplate of the housing. The cover is typically pivotally connected to the backplate adjacent to the top surface of the housing. Thus, when the cover is opened to allow for replacement of the refill unit, the cover has a tendency to fall back to a closed position. A maintenance worker must either hold the cover in the open position while replacing the refill unit, or risk having the housing cover fall while working. This tendency for the cover to return to the closed position can be frustrating for maintenance workers trying to replace refill units, and can also increase the time necessary to perform the task.

As a result of the deficiencies of the prior art discussed above, it is apparent that a need exists for an improved dispenser housing that is simple, efficient, and is easy to refill.

SUMMARY OF THE INVENTION

In one or more embodiments, the present invention includes a dispenser having a housing with a backplate, an intermediary member pivotally connected to the backplate, and a cover pivotally connected to the intermediary member. The intermediary member is pivotally connected to the backplate adjacent to a first end of the housing, and the cover is pivotally connected to the intermediary member adjacent to a second end of the housing. The dispenser also includes a refill unit including a pump and a product reservoir. The product reservoir is flexible and resilient so that it can be compressed repeatedly.

In other embodiments, the present invention includes a dispenser housing having a backplate with a back wall, sidewalls, a top wall, and a bottom wall. The dispenser housing also includes an intermediary member pivotally connected to the backplate adjacent to the bottom wall, and a cover having a front wall, sidewalls, and a top wall, and is pivotally connected to the intermediary member adjacent to the top wall. A projection may be provided on the interior of the front wall of the cover that extends inwardly toward the back wall of the backplate. Another projection may be provided on the interior of the back wall of the backplate extending inwardly toward the front wall of the cover.

DETAILED DESCRIPTION OF THE INVENTION

Figure 1:
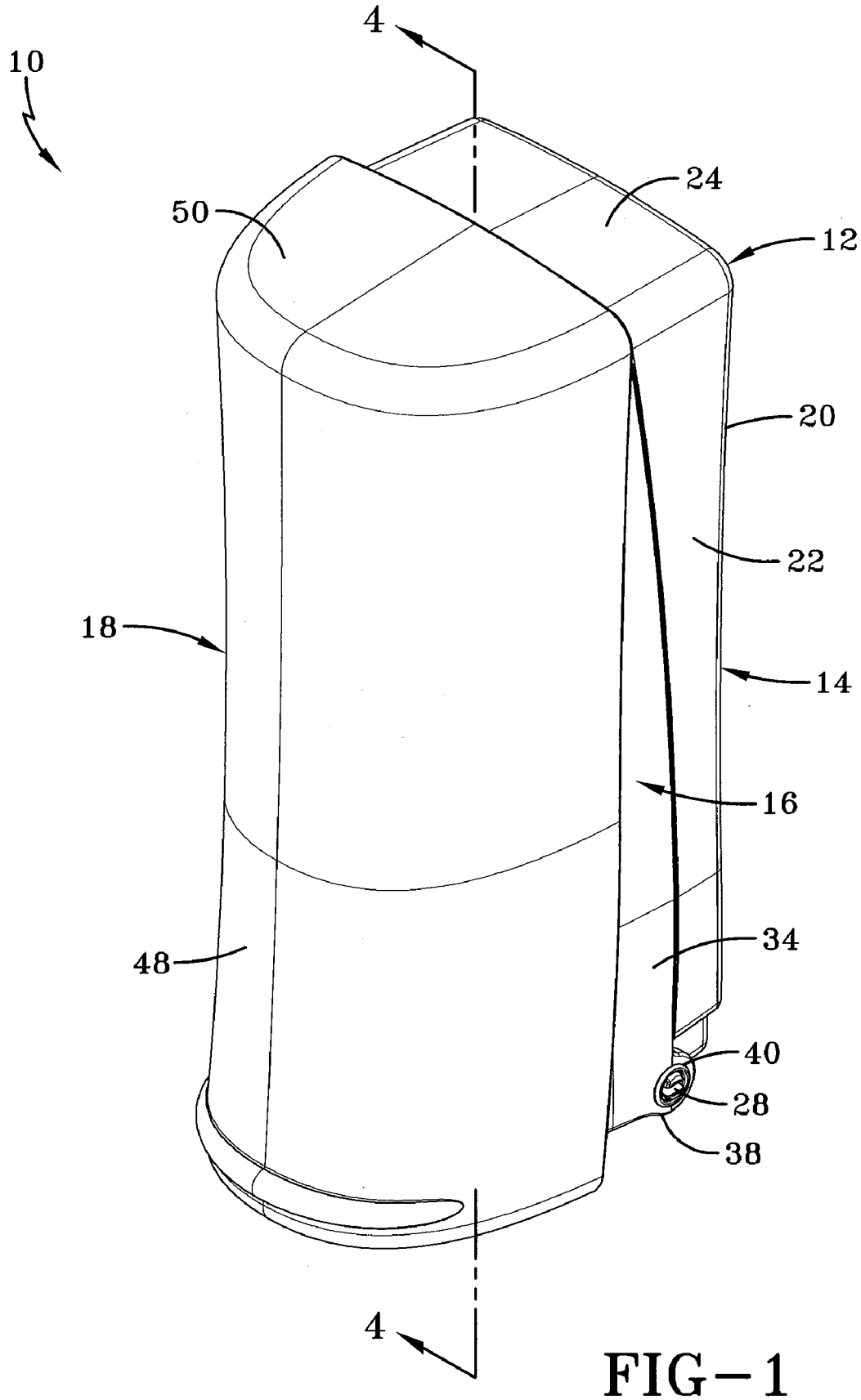
FIG. 1 is a perspective view of the dispenser of the present invention in a closed position.
Figure 2:
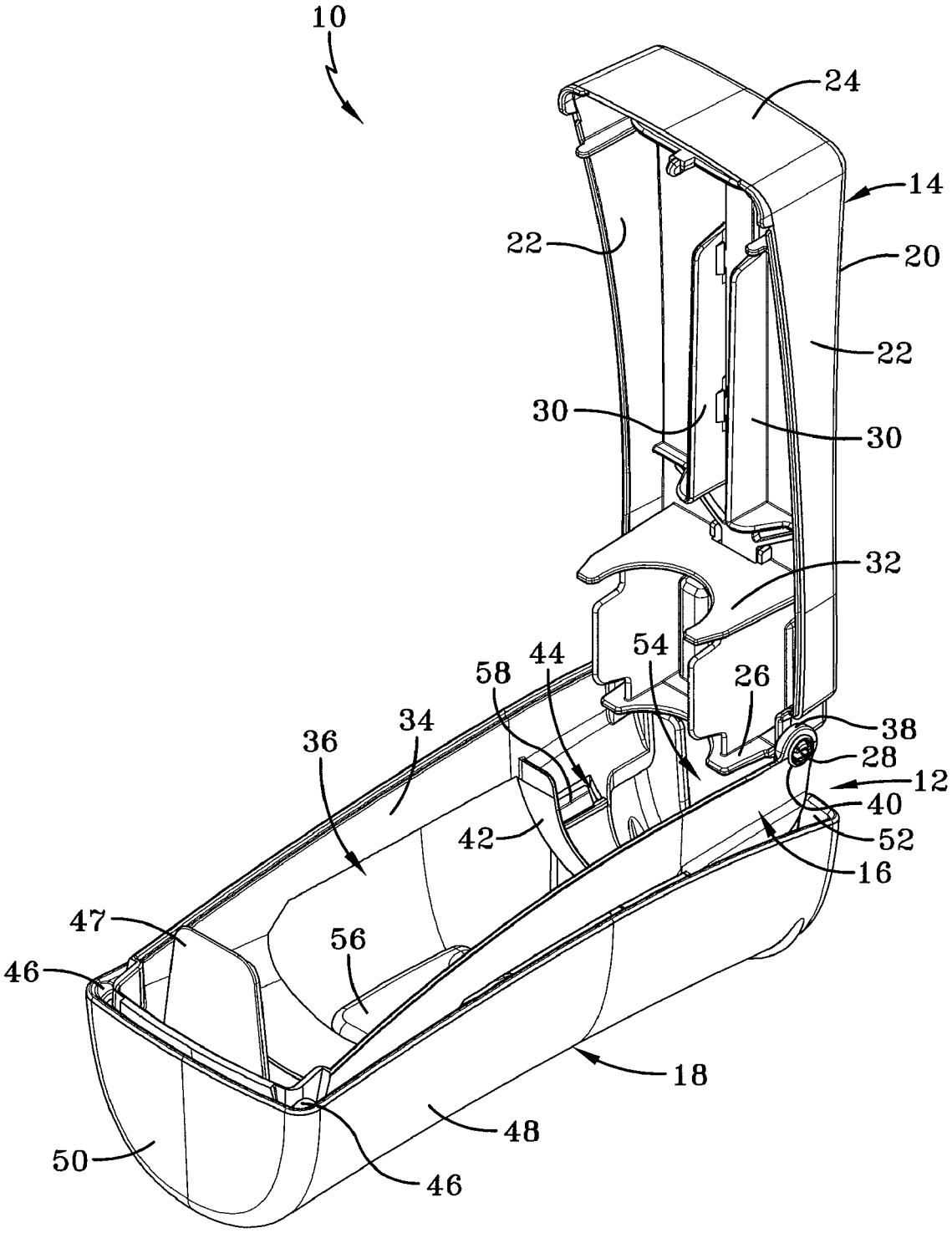
FIG. 2 is a perspective view of the dispenser housing of the present invention with the cover and intermediary member in an open position to allow for insertion of a refill unit.
Figure 3:
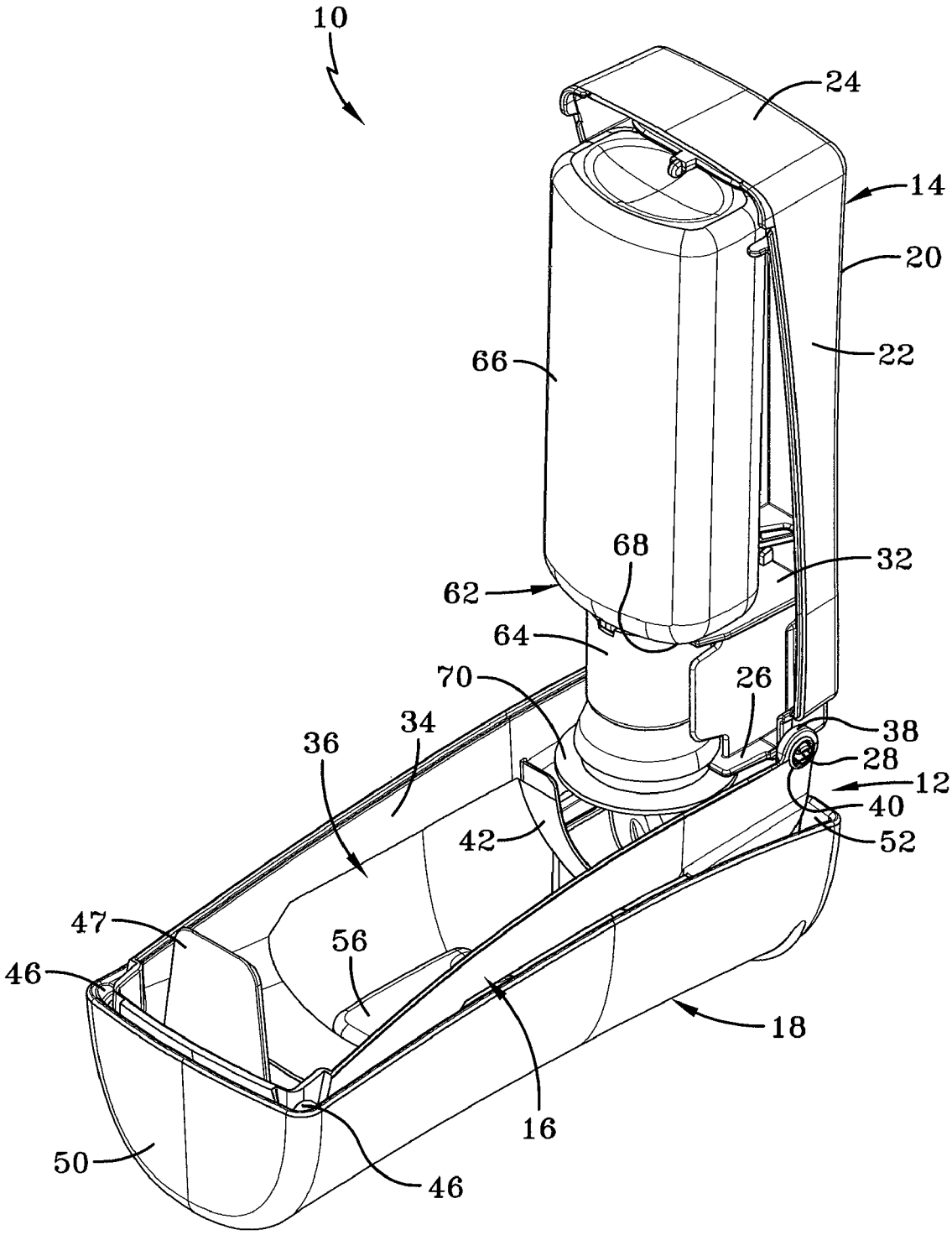
FIG. 3 is a perspective view of the dispenser housing as in FIG. 2 showing the refill unit within the housing.
Figure 4:
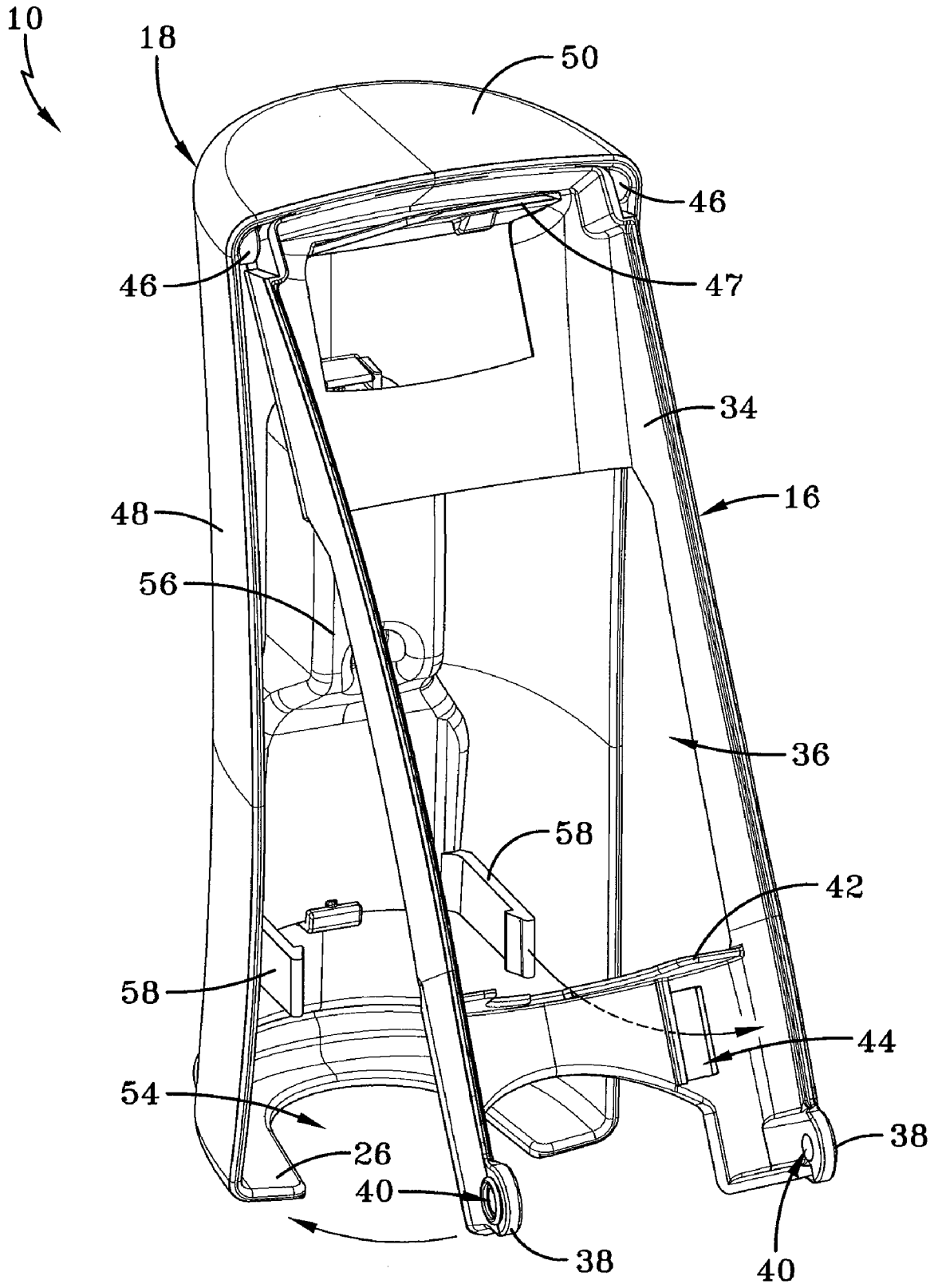
FIG. 4 is a perspective view of the cover and intermediary member of the dispenser housing.
Figure 5:
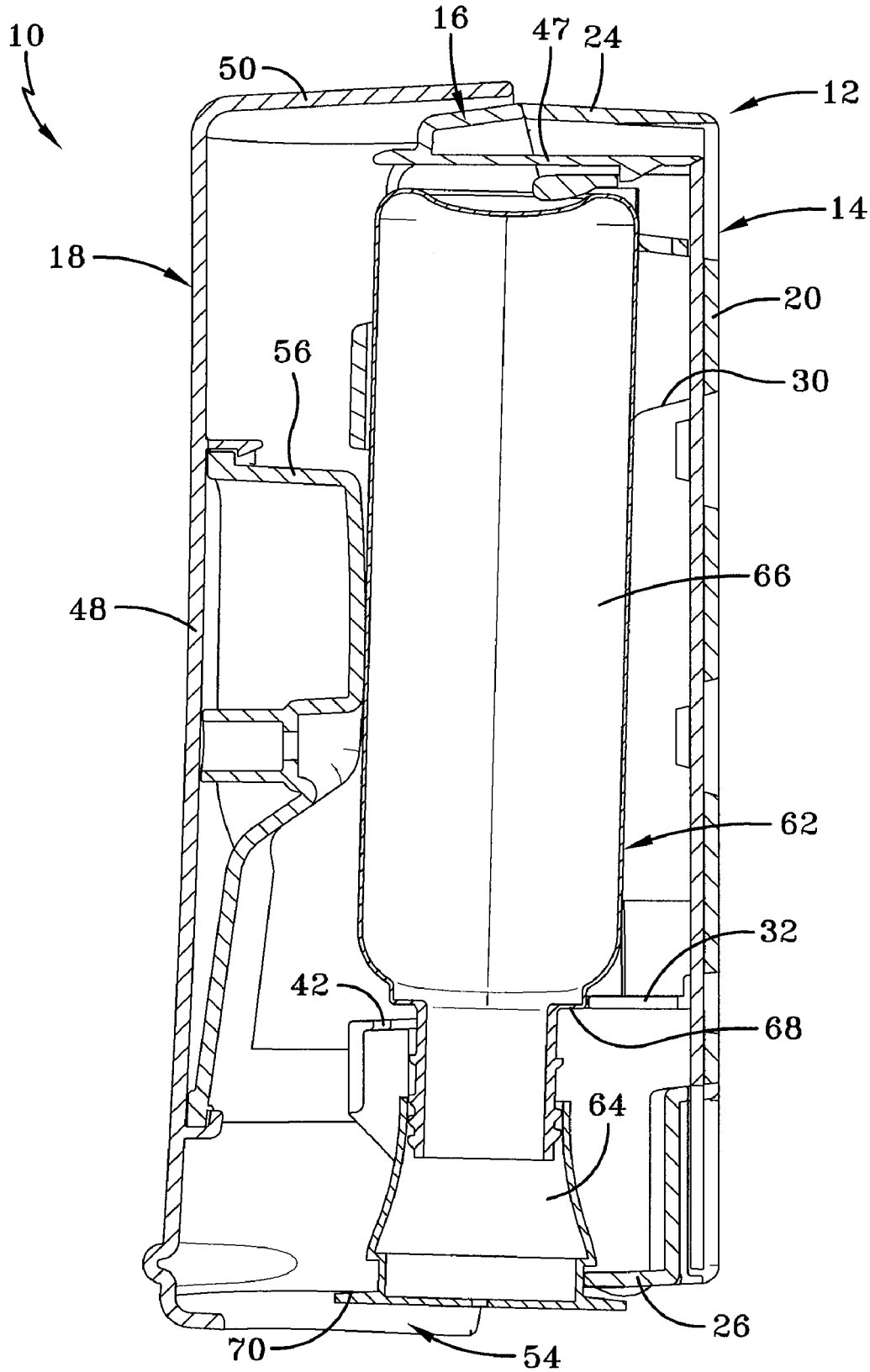
FIG. 5 is a section view of the dispenser housing of FIG. 1, including a refill unit, where the cover is in an unactuated position.

A dispenser according to the concepts of the present invention is shown in FIGS. 1-7 and is indicated generally by the numeral 10. Dispenser 10 includes a dispenser housing 12 having a backplate 14, an intermediary member 16, and a cover 18. Intermediary member 16 is pivotally secured to backplate 14 at a first end of backplate 14. In a preferred embodiment, as shown in FIG. 1, intermediary member 16 is pivotally secured to backplate 14 adjacent a bottom end of housing 12, and cover 18 is pivotally secured to intermediary member 16 adjacent the top end of dispenser housing 12. Backplate 14, intermediary member 16, and cover 18 define an inner cavity within dispenser 10. Cover 18 is adapted to pivot relative to intermediary member 16, thereby acting as a push bar to actuate dispenser 10. Intermediary member 16 pivots relative to back late 14 so as to open housing 12 for refilling or replacing a refill unit therein.

Backplate 14 is adapted to be secured to a wall or other surface, and may be so secured by any attachment mechanism known in the art. In one or more embodiments, backplate 14 may be adapted to be secured within a shower or other bathroom surface. Backplate 14 includes a back wall 20, side walls 22, a top wall 24, and a bottom wall 26. The side walls 22 extend from opposing edges of back wall 20, and are oriented generally perpendicular thereto. Top wall 24 and bottom wall 26 extend from opposing edges of back wall 20 between side walls 22. Bottom wall 26 may include an opening or recess therein to facilitate dispensing of liquid or foam from dispenser 10, as will be discussed in detail below. Backplate 14 also includes a pair of journals 28, one extending outwardly from each side wall 22 adjacent bottom wall 26. Journals 28 are positioned coaxially on side walls 22 and define a pivot axis about which intermediary member 16 rotates.

Backplate 14 also includes projections 30 extending inwardly from back wall 20. Projections 30 are generally perpendicular to back wall 20 and are oriented substantially vertically within housing 12. While a pair of parallel projections 30 are shown in the drawings, it is contemplated that other forms of projections 30 may be utilized. For example, a solid block-like projection may be provided having a width approximately equal to the space between projections 30 shown in the drawings. A retaining collar 32 also extends from back wall 20 and is oriented generally perpendicular thereto. Retaining collar 32 includes a radiused recess on an inner edge thereof that is adapted to receive a refill unit and secure it within dispenser 10.

Intermediary member 16 includes a body 34 that is arched in the transverse direction creating a radiused inner surface. Body 34 includes an opening 36 therethrough to allow for actuation of the dispenser 10, as will be discussed below. Ears 38 are provided on opposing sides of body 34 adjacent to bottom wall 26 of backplate 14. Ears 38 include apertures 40 therethrough that are adapted to receive journals 28 of backplate 14, thereby pivotally securing intermediary member 16 to backplate 14.

A retaining collar 42 extends from the interior surface of body 34, and is positioned opposite retaining collar 32 of backplate 14 when intermediary member 16 is in a closed position. Retaining collar 42 includes a radiused recess on an interior edge thereof so that together with retaining collar 32 a generally circular opening is defined. A pair of slots 44 are provided through body 34 of intermediary member 16 below retaining collar 42 to help to secure cover 18 to intermediary member 16, as will become apparent from the description below. Intermediary member 16 also includes journals 46 extending outwardly from opposing sides of body 34 adjacent to a top end thereof. Journals 46 are positioned coaxially, and define a cover pivot axis about which cover 18 rotates. Intermediary member 16 may also include a latch 47 extending therefrom, which acts to secure the top end of intermediary member 16 to backplate 14. A release bar may be provided in backplate 14 which, when pressed upward, causes latch 47 to disengage and allows dispenser 12 to be opened. Release bar may optionally be keyed so that only authorized personnel have access to the interior of dispenser 12, as is well known in the art.

Cover 18 includes a front wall 48, a top wall 50, and a bottom wall 52. Front wall 48 is arched in the transverse direction, thereby creating a radiused outer surface. Bottom wall 52 may include a dispensing opening 54 to facilitate the dispensation of liquid or foam from dispenser 10. A projection 56 extends inwardly from the inner surface of front wall 48 toward projections 30 on backplate 14. Projection 56 of cover 18 extends through opening 36 in intermediary member 16. A pair of flexible arms 58 may extend inwardly from the interior surface of front wall 48 to secure cover 18 to intermediary member 16. The flexible arms 58 extend through slots 44 in intermediary member 16 and may include latch members on the ends thereof to prevent cover 18 from being pulled away from intermediary member 16. Cover 18 also includes inwardly facing pivot apertures 60 on opposing sides of front wall 48 adjacent to top wall 50. Pivot apertures 60 are adapted to receive journals 46 of intermediary member 16, thereby pivotally securing cover 18 to intermediary member 16.

A refill unit 62 is positioned within dispenser 10 and includes a valve mechanism 64 and a product reservoir 66. Valve mechanism 64 may be any such valve mechanism known to those skilled in the art, and may be adapted to dispense a liquid or a foam product. For example, it is contemplated that valve mechanism 64 may be a foam producing valve such as the EZi® Foamer manufactured and sold by Rexam Airspray, Inc. Product reservoir 66 may be flexible and resilient, thus allowing it to be compressed and providing it with the capability of returning to its original form. Sufficient space is provided around product reservoir 66 within housing 12 to allow it to flex or expand in various directions when compressed. In one or more embodiments, sufficient space is provided within housing 12 to allow product reservoir to expand or flex in the lateral direction (perpendicular to the direction of compression) by at least 5% of it's original size, in other embodiments at least 10%, and in still other embodiments at least 15%. Product reservoir 66 includes a shoulder 68 at its lower edge that is adapted to rest on retaining collar 32 and retaining collar 42 to support refill unit 62 within dispenser 10. Valve mechanism 64 may be provided with a circumferential flange 70 at its extreme end, flange 70 acting to position and secure valve mechanism 64 within dispenser 10.

Figure 6:
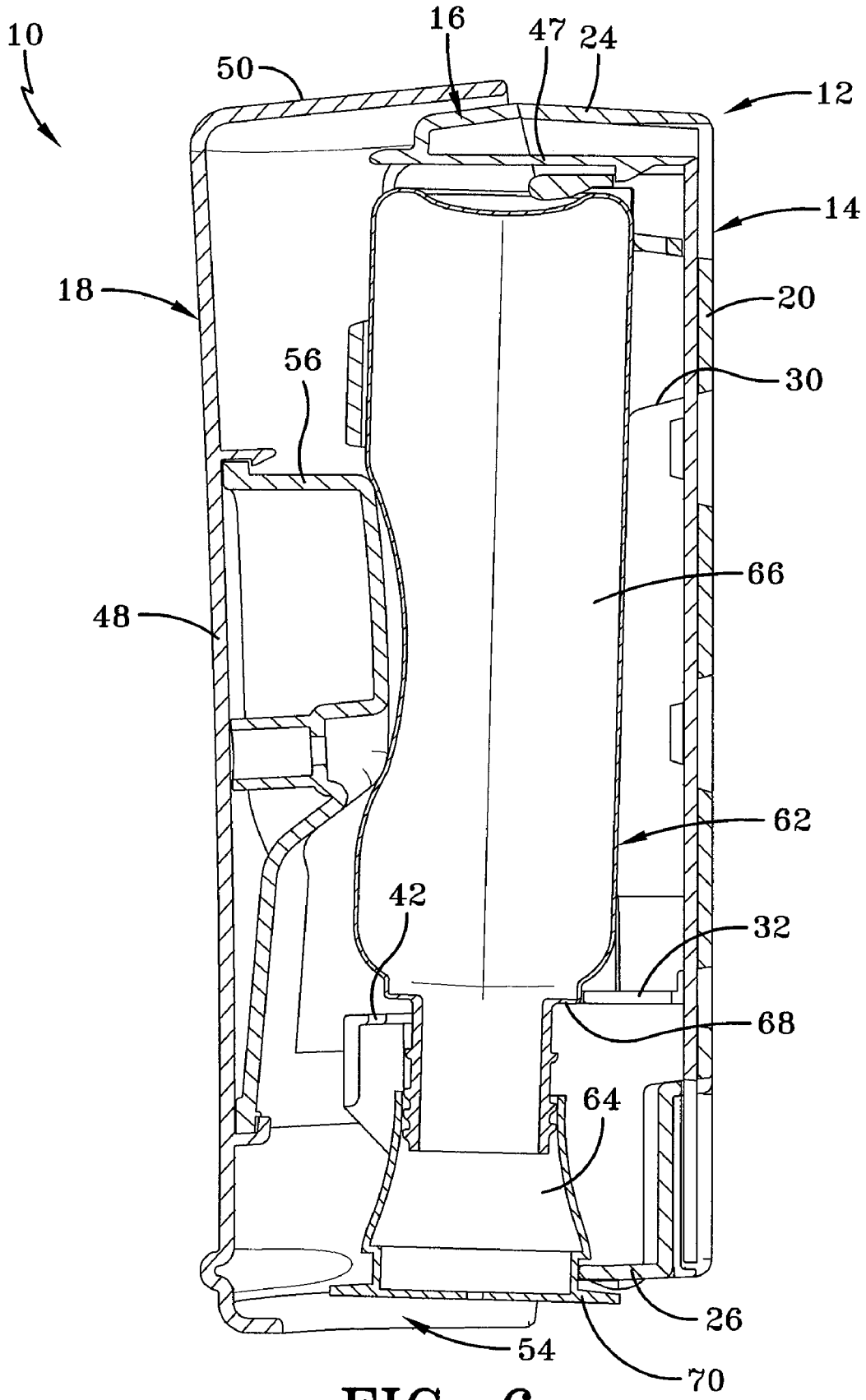
FIG. 6 is a section view as in FIG. 5, where the cover is in an actuated position.

As seen in FIG. 6, cover 18 may be pressed toward backplate 14 to actuate dispenser 10. Projection 56 extends through opening 36 when cover 18 is pressed, thereby engaging and compressing product reservoir 66 to force product therein through valve mechanism 64. Projections 30 on back wall 20 of backplate 14 maintain product reservoir 66 in a displaced position relative to back wall 14 of housing 12, thereby maintaining a sufficient amount of space around product reservoir 66 to allow it to flex. This ability of product reservoir 66 to flex when compressed improves the performance of valve mechanism 64.

When product reservoir 66 is compressed by projection 56, a volume of liquid or foam is caused to be dispensed from valve mechanism 64. The liquid or foam passes through dispensing opening 54 of cover 18, and may be retrieved by the person actuating dispenser 10. The natural resiliency of product reservoir 66 causes it to return to its original shape, thereby forcing cover 18 into an unactuated position by acting upon projection 56. The expansion of product reservoir 66 after compression also creates a vacuum therein, which draws air in through valve mechanism 64. This air intake, or "suck back" causes any product remaining in the valve mechanism 64 to be drawn back into product reservoir 66, and also provides air within valve mechanism 64 to be used to generate foam product, where necessary. This air intake function may also be accomplished by one-way valves in the product dispenser. Dispenser 10 is then in a condition to be actuated again.

Upon actuation cover 18 pivots relative to intermediary member 16 and backplate 14 by virtue of journals 46 and pivot apertures 60, both positioned adjacent top wall 50 of cover 18. This arrangement allows a user to press the lower portion of cover 18 to actuate dispenser 10 and cause liquid or foam to be dispensed. Thus, it is possible for a person to press cover 18 to actuate dispenser 10 and cover dispensing opening 54 to catch the liquid or foam dispensed with one hand.

Figure 7:
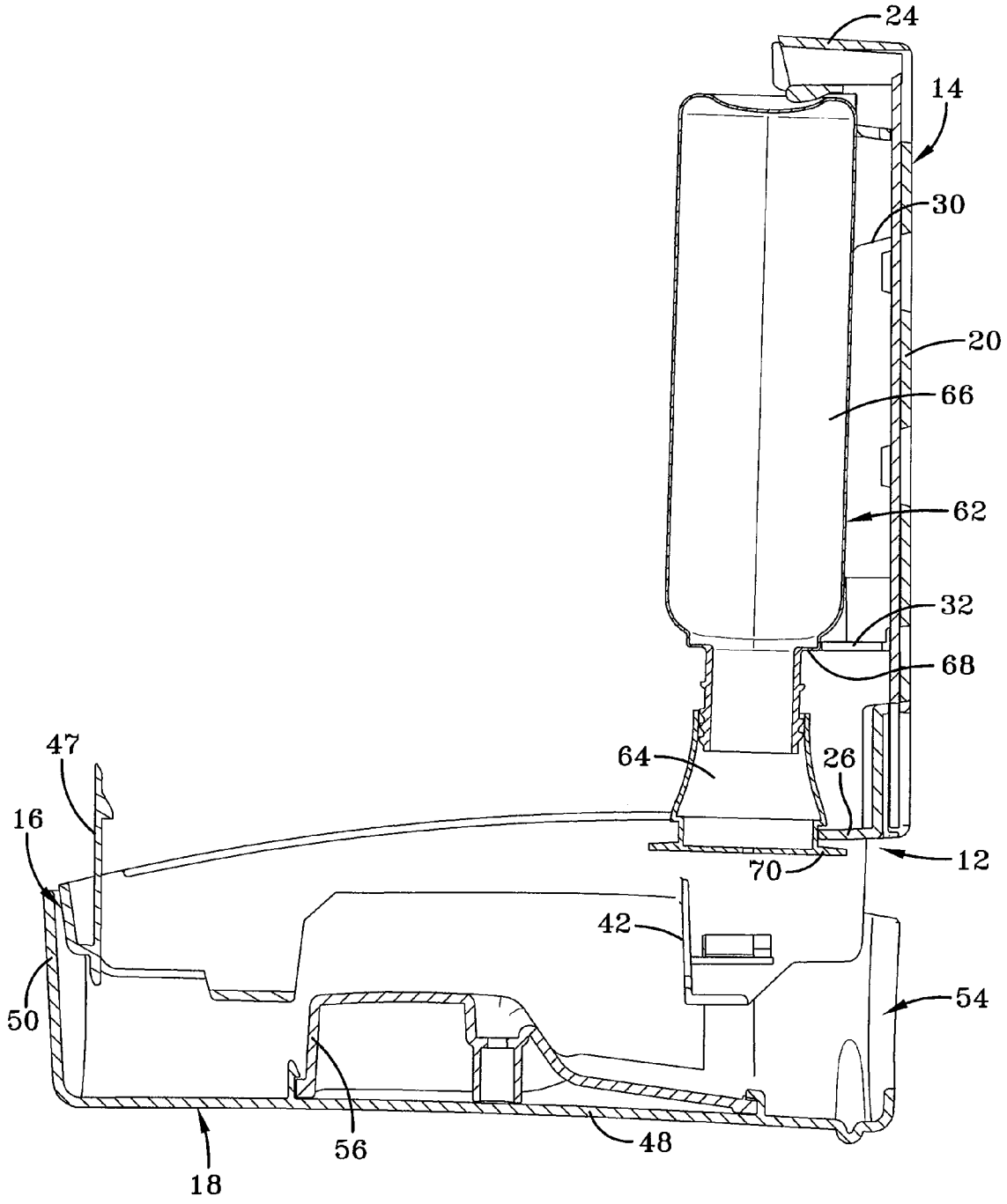
FIG. 7 is a section view as in FIG. 5, where the pivoting intermediary member and the cover are open to allow refilling of the dispenser.

To refill or replace refill unit 62, housing 12 may be opened by pressing latch 47 and pivoting intermediary member 16 and cover 18 relative to backplate 14. Intermediary member 16 pivots by virtue of journals 28 and apertures 40 in ears 38, which connect it to backplate 14 adjacent to bottom wall 26. This arrangement allows housing 12 to be opened by pivoting intermediary member 16 and cover 18 downward, as shown in FIG. 7. Thus, the refill unit 62 may be replaced without worrying that part of the housing may swing close.

In light of the foregoing, it should be clear that this invention provides improvements in the art of skin-care product dispensers. While a particular embodiment has been disclosed herein for the purpose of teaching the inventive concepts, it is to be appreciated that the invention is not limited to or by any particular structure shown and described. Rather, the claims shall serve to define the invention.

What is claimed is:

1. A dispenser comprising:

a housing including a backplate, an intermediary member pivotally connected to said backplate adjacent a first end of said housing, and a cover carried by said intermediary member and pivotally connected to said intermediary member adjacent a second end of said housing, said intermediary member and said cover adapted to pivot together between an open position for refilling and a closed position for dispensing; and a refill unit including a valve mechanism and a product reservoir, said product reservoir being flexible and resilient, wherein said intermediary member includes an opening therethrough to allow said cover to engage said refill unit to actuate said dispenser.

2. The dispenser of claim 1, wherein said backplate includes an inwardly extending projection.

3. The dispenser of claim 1, wherein said backplate includes a collar for receiving and securing said refill unit within said housing.

4. The dispenser of claim 2, wherein said cover includes an inwardly extending projection, and wherein said opening in said intermediary member is adapted to allow said projection of said cover to extend therethrough.

5. The dispenser of claim 1, wherein said valve mechanism is adapted to dispense a liquid product from the dispenser.

6. The dispenser of claim 1, wherein said valve mechanism is adapted to dispense a foam product from the dispenser.

7. A dispenser comprising:

a housing having a top end and a bottom end spaced from said top end, the housing including a backplate, an intermediary member extending substantially between said top end and said bottom end, said intermediary member pivotally connected to said backplate adjacent to said bottom end of said housing, and a cover carried by said intermediary member and pivotally connected to said intermediary member adjacent to said top end of said housing, said intermediary member and said cover adapted to pivot together between an open position for refilling and a closed position for dispensing wherein said backplate, intermediary member, and cover together define an inner cavity that is configured to accept a refill unit including a valve mechanism and a product reservoir, said product reservoir being flexible and resilient, and wherein said cover is movable independent of said intermediary member for actuating the dispenser.

8. The dispenser of claim 7, wherein said backplate includes an inwardly extending projection.

9. The dispenser of claim 7, wherein said backplate includes a collar for receiving and securing said refill unit within said housing.

10. The dispenser of claim 8, wherein said cover includes an inwardly extending projection, and wherein said intermediary member includes an opening therein adapted to allow said projection of said cover to extend therethrough.

* * * * *